US006886729B1

(12) United States Patent
Lee

(10) Patent No.: US 6,886,729 B1
(45) Date of Patent: May 3, 2005

(54) TRIGGER USED IN SINGLE SHOOTING AND DOUBLE SHOOTING OF NAIL DRIVERS

(76) Inventor: Hsing-Chang Lee, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/762,142

(22) Filed: Jan. 22, 2004

(51) Int. Cl.[7] ..... B25C 1/04
(52) U.S. Cl. ..... 227/8; 227/130
(58) Field of Search ..... 227/8, 130, 142

(56) References Cited

U.S. PATENT DOCUMENTS 5,551,621 A * 9/1996 Vallee ..... 227/8
5,791,545 A * 8/1998 Lin ..... 227/8
5,836,501 A * 11/1998 Lai ..... 227/8
6,059,161 A * 5/2000 Chang et al. ..... 227/8
6,116,488 A * 9/2000 Lee ..... 227/8
6,213,372 B1 * 4/2001 Chen ..... 227/8
6,357,647 B1 * 3/2002 Ou ..... 227/8
6,431,425 B1 * 8/2002 Moorman et al. ..... 227/8
6,662,989 B1 * 12/2003 Chang et al. ..... 227/8

* cited by examiner

*Primary Examiner*—Scott A. Smith

(57) ABSTRACT

A trigger device used in single shooting and double shooting of a nail driver comprises a machine body having a safety device at a front end of the machine body; a switch having an eccentric shaft pivotally installed to the machine body and an adjusting body pivotally installed to the eccentric shaft; and a triggering device having a trigger, a movable inner sheet and an elastomer. One end of the trigger is pivotally installed to the eccentric shaft of the switch; and another end of the trigger is pivotally to the movable inner sheet which resists against the eccentric shaft. The elastomer is installed to a valve rod and resists against the movable inner sheet. When the safety rod and the trigger are pressed, by the interaction of the safety device, switch and the triggering device, the nail driver is operated to beat nail one time or several times continuously.

3 Claims, 11 Drawing Sheets

TRIGGER USED IN SINGLE SHOOTING AND DOUBLE SHOOTING OF NAIL DRIVERS

FIELD OF THE INVENTION

The present invention relates to nail drivers, and particular to a trigger used in single shooting and double shooting of a nail driver.

BACKGROUND OF THE INVENTION

Triggering modes of a nail driver may be classified as single shooting mode and continuous shooting mode. In the continuous shooting mode, the trigger is pressed continuously so as to beat a nail continuously. In the single shooting mode, each time, the trigger is pressed, only one nail is beaten so that the number and positions of nails to be beaten are strictly confined. However, these two ways are not confined by any control device so that the user operates the nail driver by his or her sense. Mistakes occur occasionally.

Thereby, a safety device is added to the nail driver with single and continuous shooting operations, but this prior art still has following disadvantages. Firstly, the components are too complicated to be manufactured easily. The parts are irregular, this make the manufacturing process complicated. It must stop the work for a while to select a shooting mode and to press the safety device so as to make the workers feel uncomfortable in the working process. Namely, the operation cannot be make continuously.

SUMMARY OF THE INVENTION

Accordingly, the primary object of the present invention is to provide a trigger device used in single shooting and double shooting of a nail driver comprises a machine body, a switch, and a trigger means.

The machine body has a safety device; one end of the safety device is at a front end of the machine body.

The switch has an eccentric shaft and an adjusting body. The eccentric shaft is pivotally installed to the machine body. The adjusting body has an eccentric hole. The adjusting body is pivotally installed to the eccentric shaft.

The triggering means has a trigger, a movable inner sheet and an elastomer. The triggering means is capable of being pushed by another end of the machine body. One end of the trigger has a resisitng portion. The resisting portion has a hollow portion. A touch block is movable in the hollow portion. One end of the trigger is pivotally installed to the eccentric shaft of the switch; and another end of the trigger is pivotally to the movable inner sheet. The movable inner sheet resists against the eccentric shaft. The elastomer is installed to a valve rod of machine body and resists against the movable inner sheet.

When the safety rod and the trigger are pressed, by the interaction of the safety device, switch and the triggering means, the nail driver is operated to beat nail one time or several times continuously.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
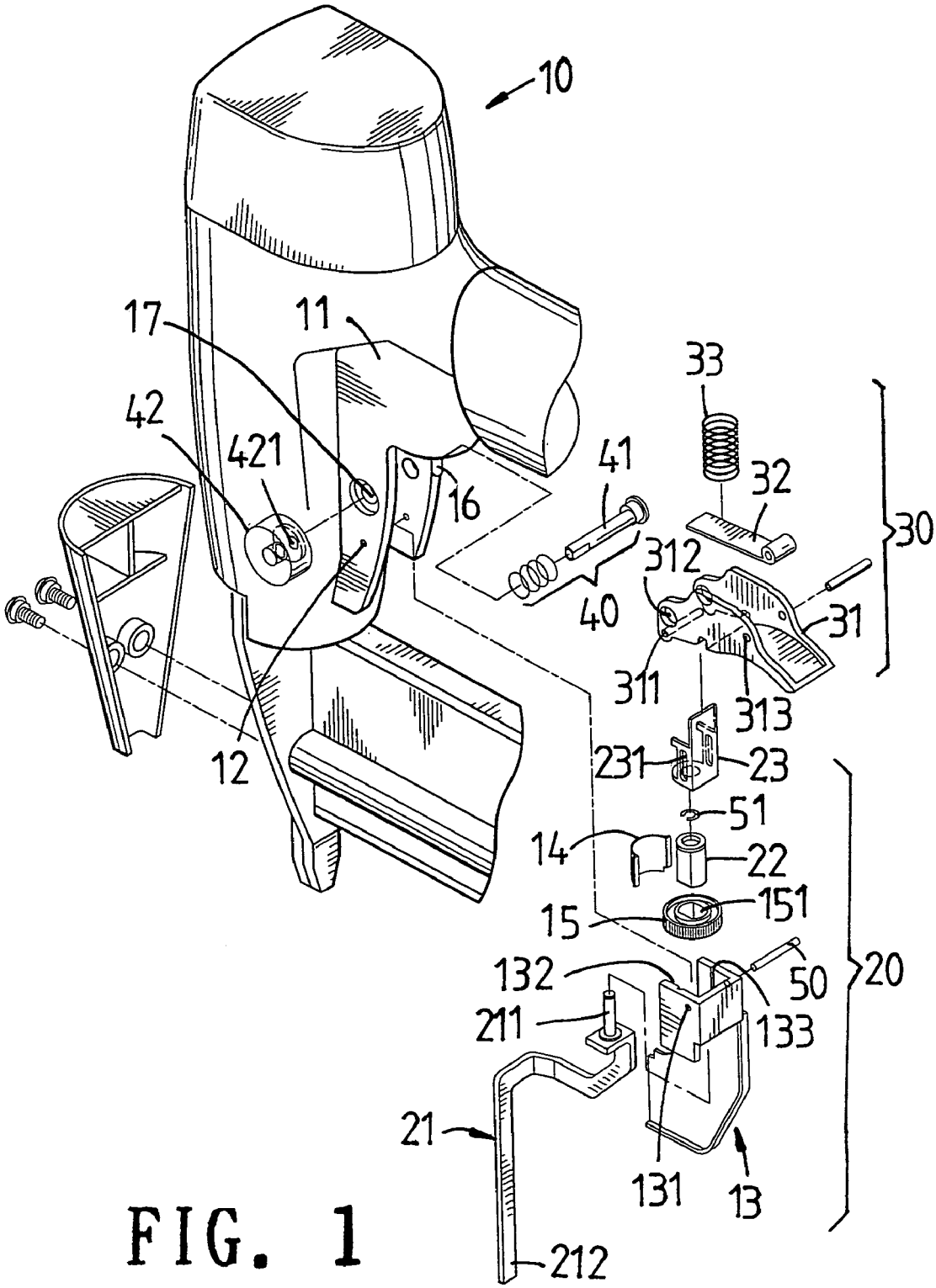
FIG. 1 is an exploded schematic view of the present invention.
Figure 2:
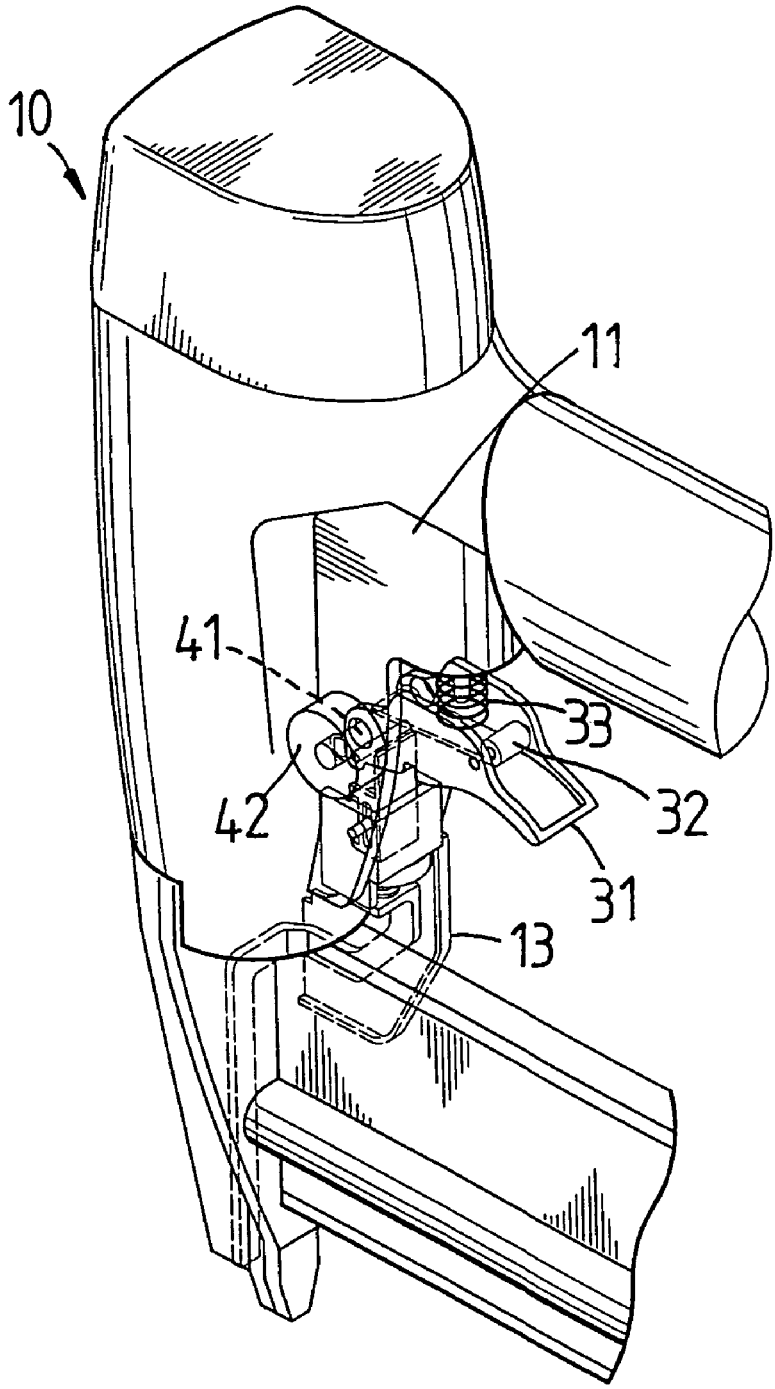
FIG. 2 is an assembled view of the present invention.
Figure 3:
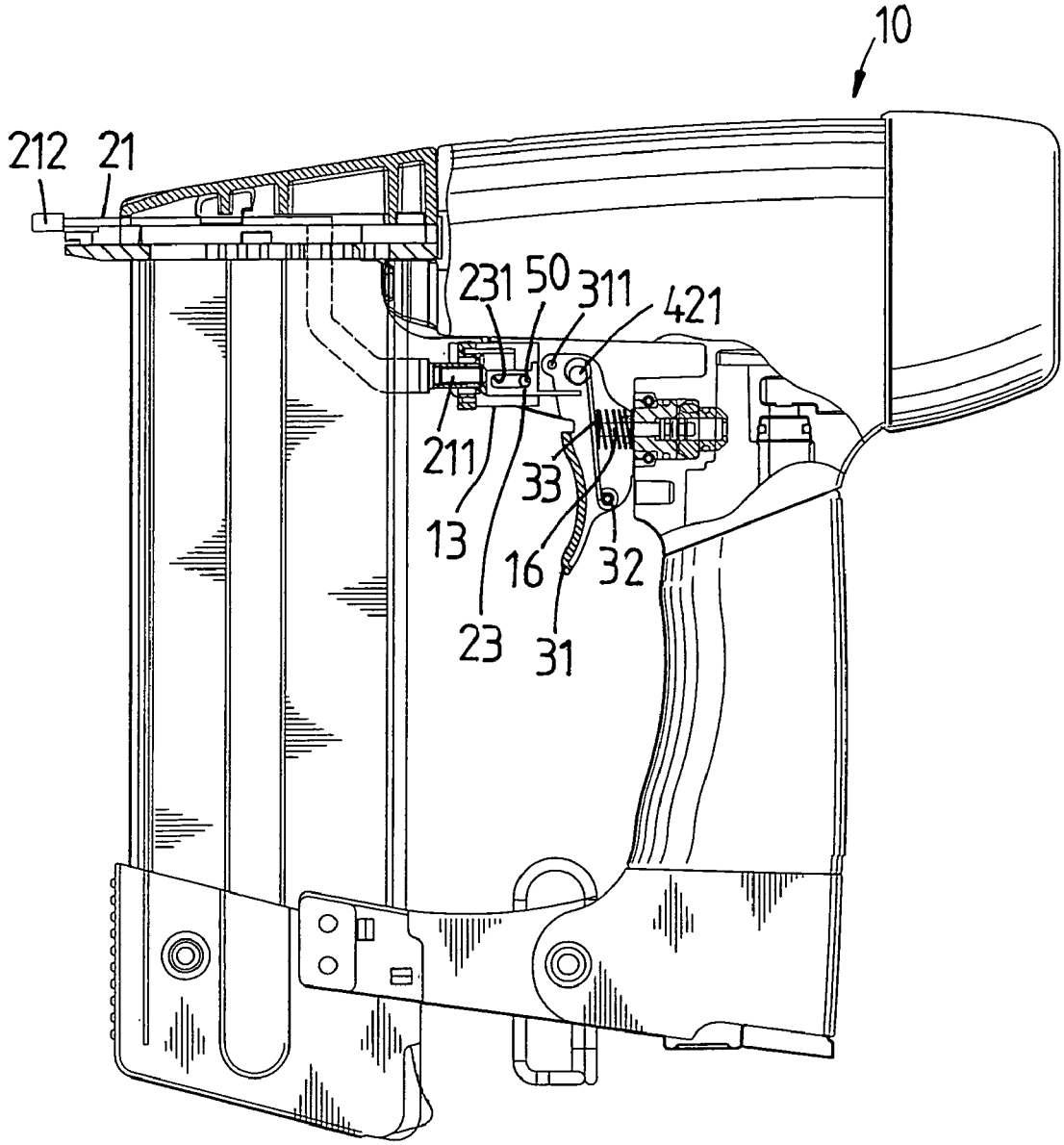
FIG. 3 is a cross section view of the present invention.

Referring to FIG. 1, the trigger used in single shooting and double shooting of the present invention is illustrated. The trigger structure includes a machine body 10, a safety device 20, a triggering means 30, and a switch 40.

The machine body 10 has a fixing portion 11. Two sides of the fixing portion 11 have respective first through holes 12. A retaining frame 13 have two second through holes 131 at two sides thereof. An axial rod 50 passes through the first through holes 12 and the second through holes 131 so as to fix the retaining frame 13 to the fixing portion 11. One end of the retaining frame 13 has a U shape which includes a groove 133. A cambered portion 14 serves to fix a sleeve 15 in the groove 133 of the retaining frame 13. A center of the sleeve 15 is formed with a receiving portion 151. Besides, the machine body 10 has a valve rod 16 at a handle thereof.

The safety device 20 includes a safety rod 21, a driving block 22 and a touch block 23. The driving block 22 inserts into the receiving portion 151 of the sleeve 15. The safety rod 21 has a push portion 211 which passes through a via hole 221 in the driving block 22. A C ring 51 buckles on the via hole 221. An outer end of the driving block 22 has an annular trench 222 for buckling the touch block 23. Each of two sides of the touch block 23 has a respective slot 231. The axial rod 50 passes through the slots 231 so that the driving block 22 is movable.

The switch 40 includes an eccentric shaft 41 and an adjusting body 42. The adjusting body 42 has an eccentric hole 421. The eccentric shaft 41 passes through the penetrating holes 17 at two sides of the fixing portion 11 and the eccentric hole 421 of the adjusting body 42 so that adjusting body 42 is pivotally installed.

The triggering means 30 includes a trigger 31, a movable inner sheet 32 and an elastomer 33. A top end of the trigger 31 is installed with a resisting portion 311. A lower side of the resisting portion 311 is hollowed for moving the touch block 23. Besides, a front end of each of two sides of the trigger 31 has a third through hole 312 and a rear end thereof has a fourth through hole 313. The eccentric shaft 41 of the switch 40 passes through the third through hole 312. The second axial rod 52 passes through the fourth through hole 313 and a hole of the movable inner sheet 32 so as to pivotally install the movable inner sheet 32 to the trigger 31. The movable inner sheet 32 resists against the eccentric shaft 41 and the elastomer 33 which is installed to the valve rod 16.

The operation of the present invention will be described here.

Figure 4:
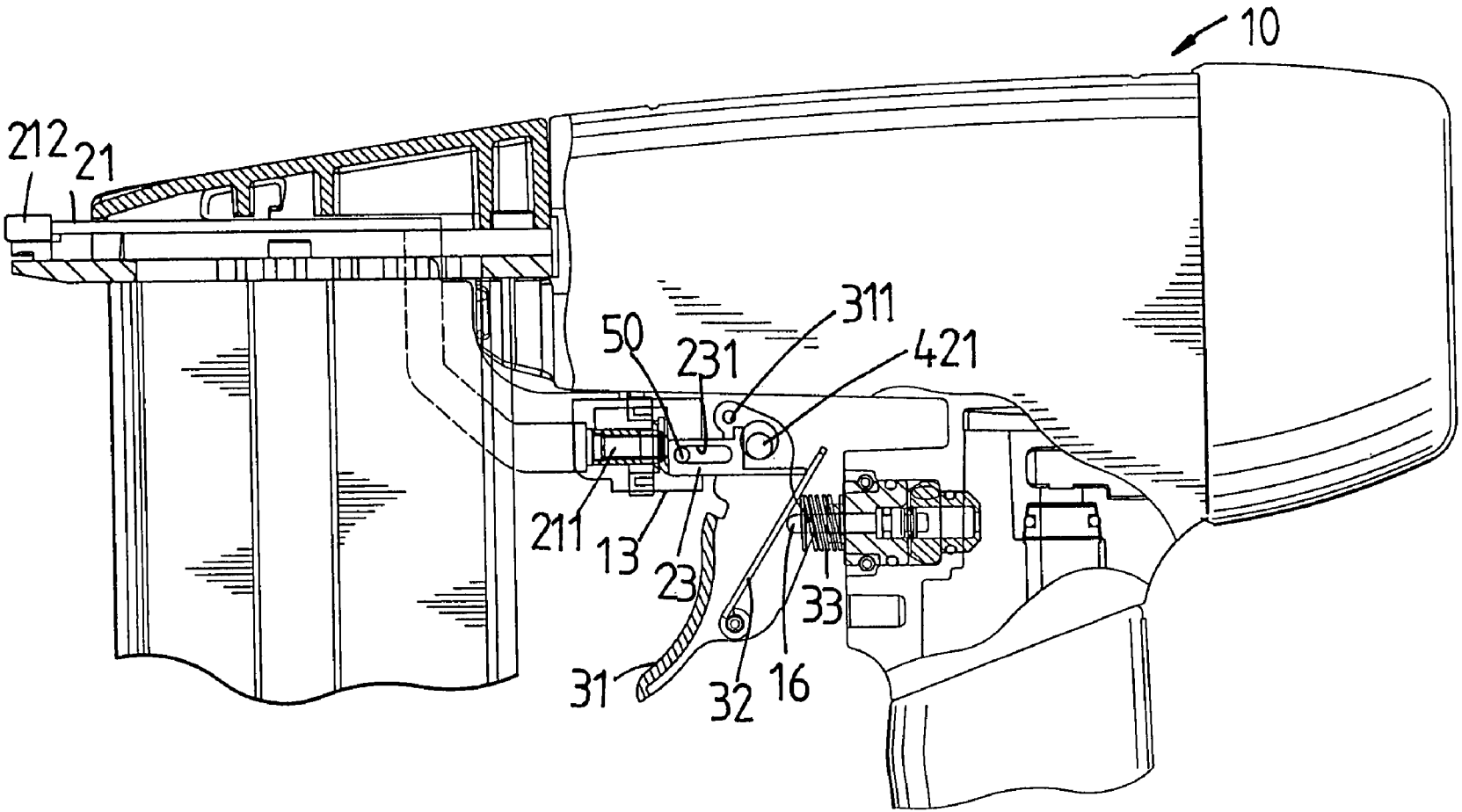
FIGS. 4 and 5 are schematic views showing the operation of single shooting of the present invention.
Figure 5:
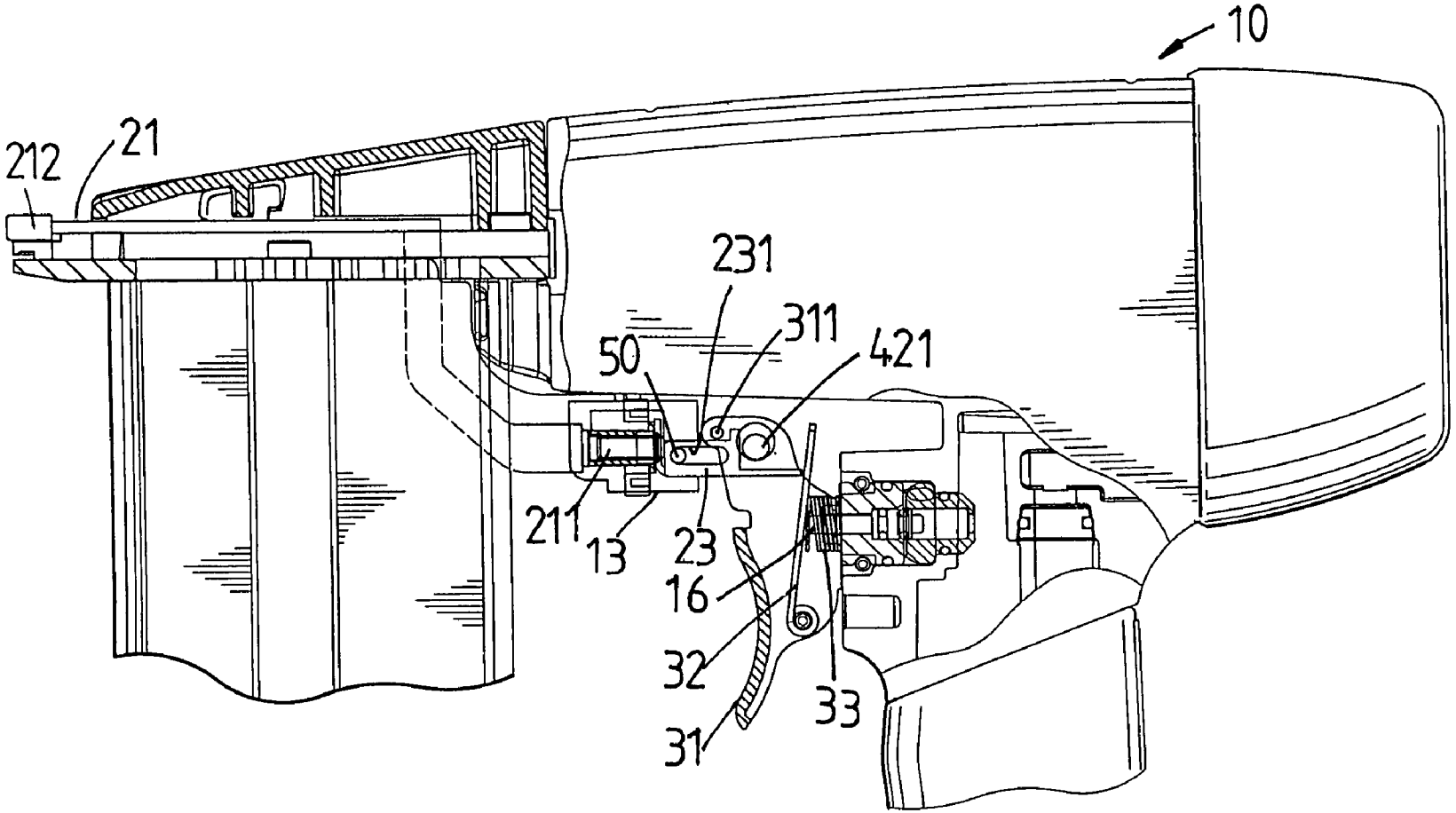

For the single shooting operation, the safety rod 21 is pressed firstly. The eccentric hole 421 of the adjusting body 42 of the switch 40 rotates. The machine body 10 will align to a nail beating position and the press section 212 of he safety rod 21 will be pressed (referring to FIG. 4) so that the safety rod 21 moves upwards. Then the resisting portion 211 will drive the driving block 22 to move upwards to drive the touch block 23 to move upwards to drive one end of the movable inner sheet 32. At this moment, the movable inner sheet 32 moves near the via rod 16, but not presses the via rod 16. When the trigger 31 is pressed (referring to FIG. 5), the trigger 31 will drive another end of the movable inner sheet 32 to press the via rod 16. Thereby, the operation of single shooting is completed.

Figure 6:
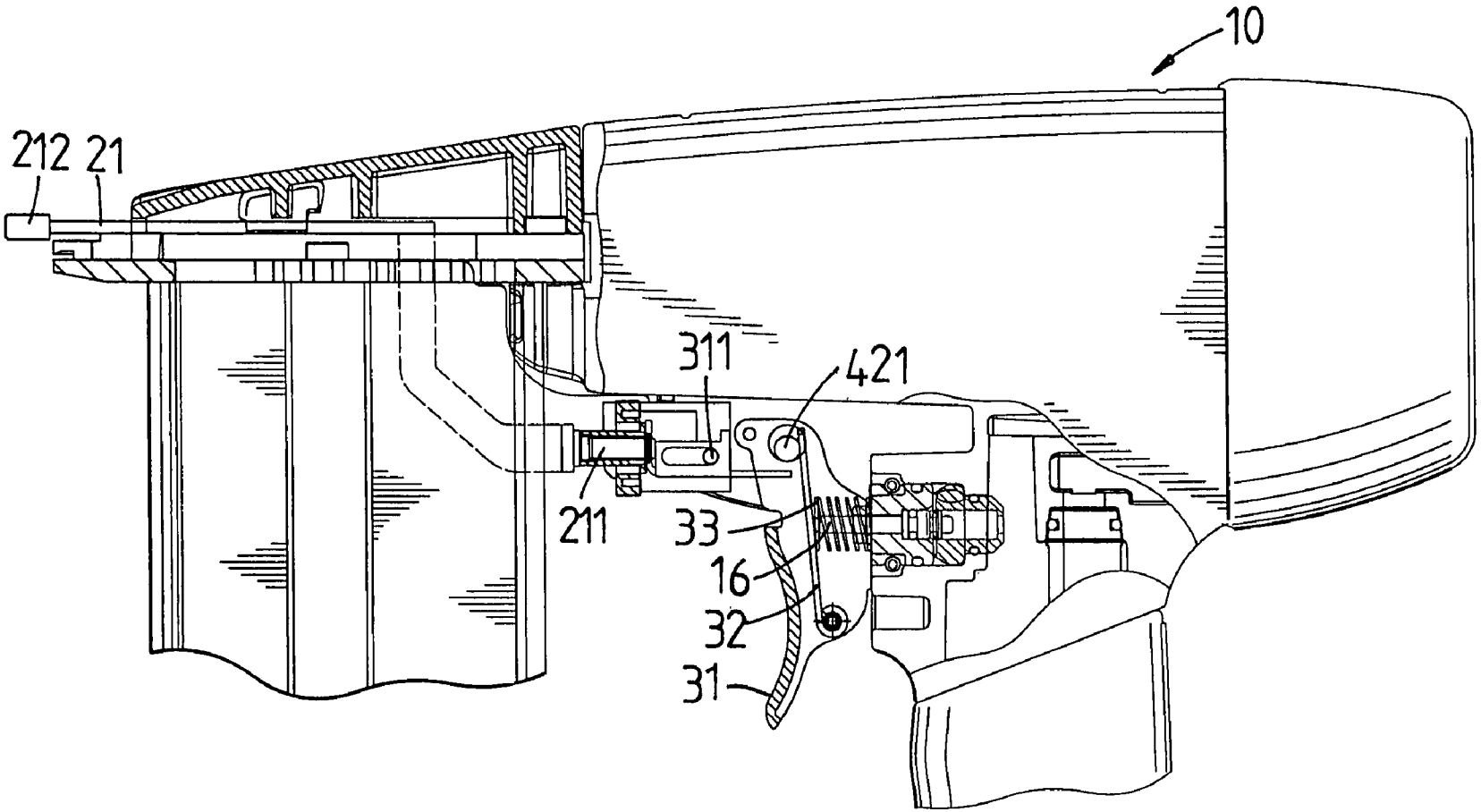
FIGS. 6 and 7 are schematic views showing that the present invention cannot be triggered.
Figure 7:
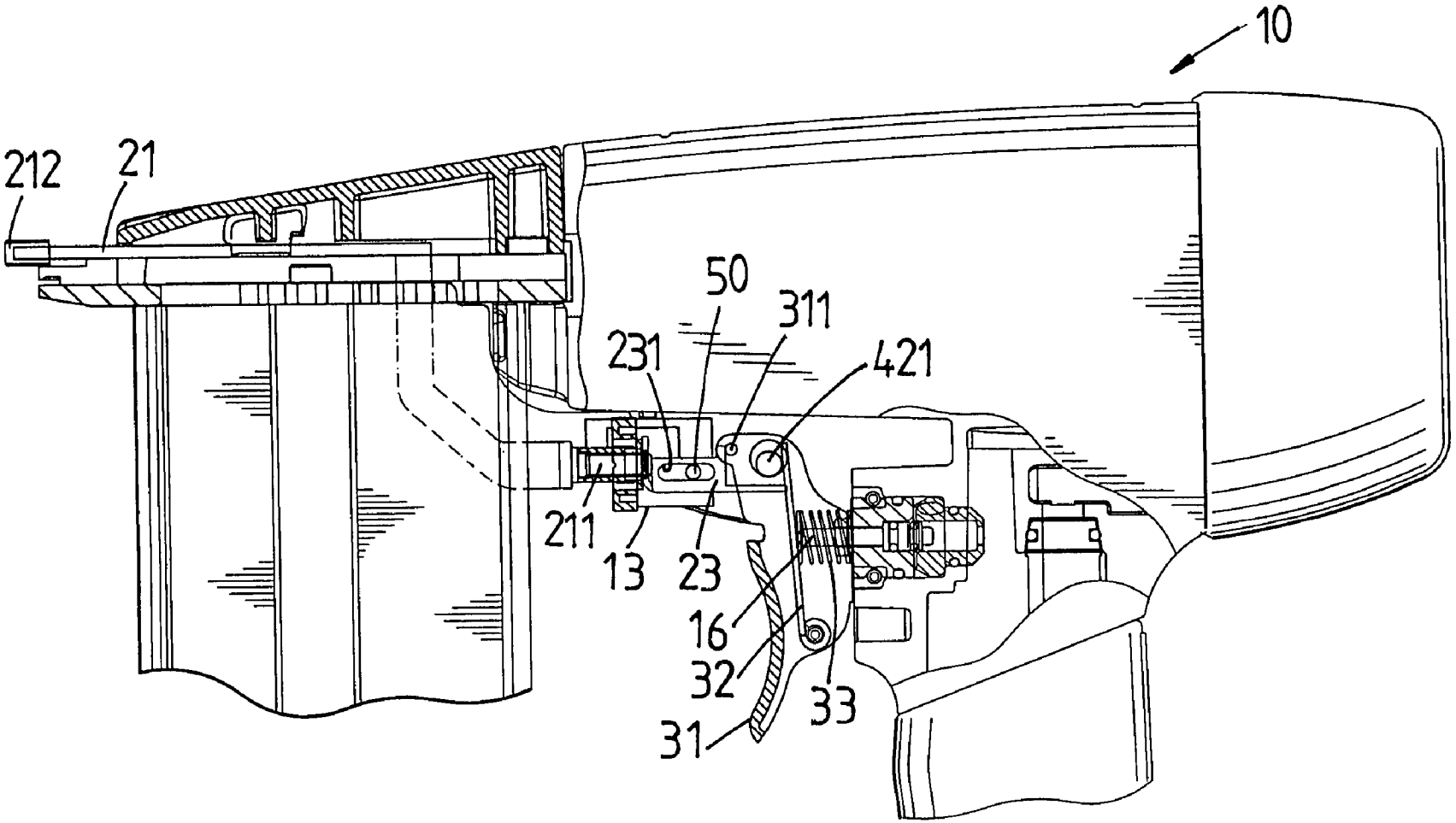

If the trigger 31 is pressed firstly (referring to FIG. 6), the trigger 31 will rotate through an angle around the eccentric shaft 41 so that the resisting portion 311 of the trigger 31 moves downwards to the right upside of the touch block 23. At this time, if the press section 212 of the safety rod 21 (referring to FIG. 7) is pressed further. The movement of the touch block 23 will be resisted by the resisting portion 311. Thereby, the operation of single shooting cannot be completed.

Figure 8:
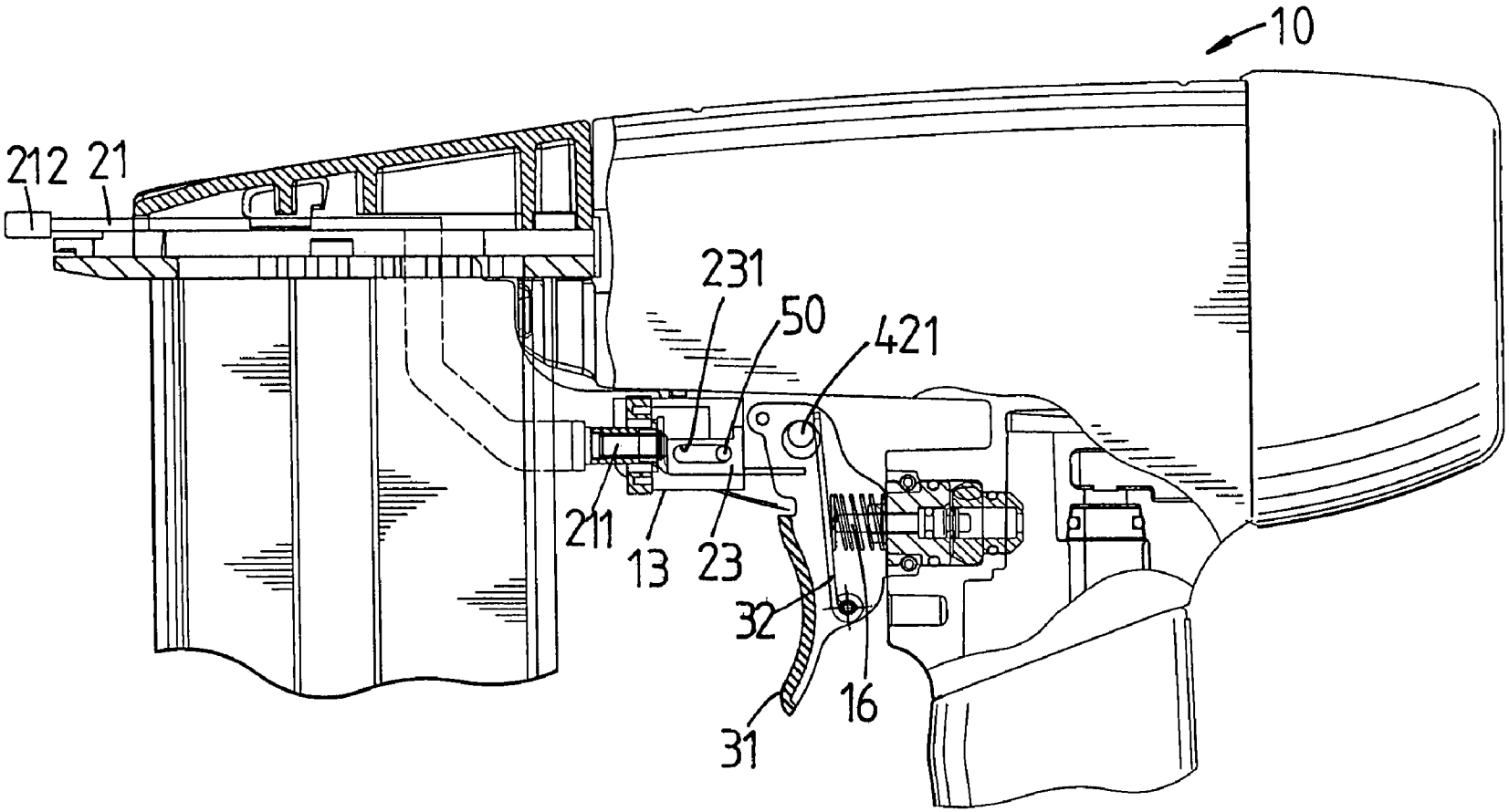
FIGS. 8 and 9 are schematic views showing the continuous shooting operation according to the present invention.
Figure 9:
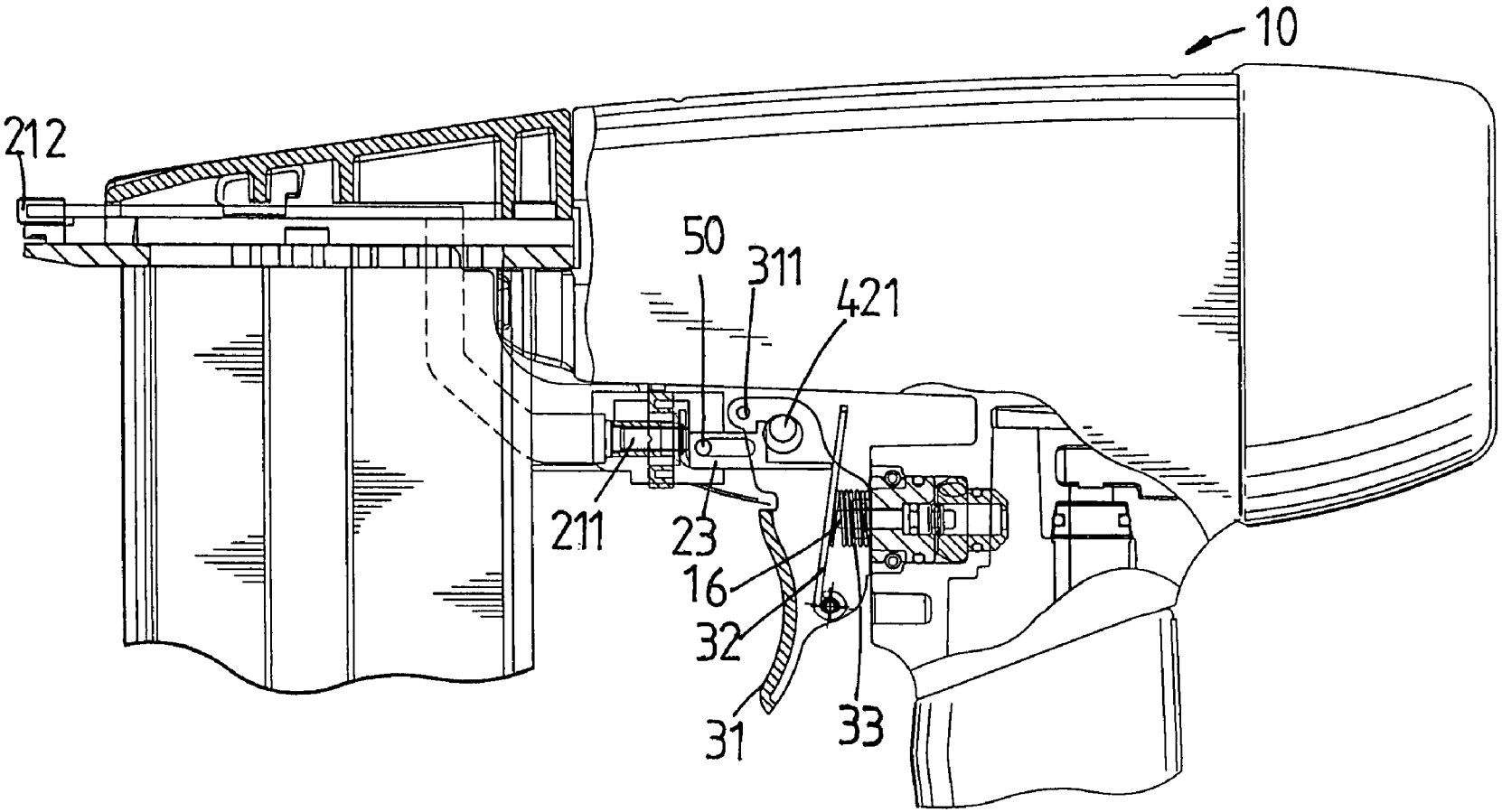

For the continuous shooting operation, the safety rod 21 or the trigger 31 is unnecessary to be pressed firstly. The eccentric hole 421 of the adjusting body 42 is rotated so that the eccentric shaft 41 moves rightwards so that the trigger 31 moves leftwards. Then the machine body 10 aligns to a nail beating position and the press section 212 of the safety rod 21 is pressed (referring to FIG. 8) so that the touch block 23 moves upwards as one end of the movable inner sheet 32 is pushed so that the movable inner sheet 32 moves near the valve rod 16 but not press the valve rod 16. When the trigger 31 is pressed (referring to FIG. 9), the trigger 31 will drive another end of the movable inner sheet 32 to press the valve rod 16 so as to complete the first triggering operation. When the safety rod 21 is released, the elastomer 33 will apply an elastic force to the movable inner sheet 32 so that the touch block 23 retracts to drive the driving block 22. Thereby, the safety rod 21 returns to the original position. When next time, the press section 212 of the safety rod 21 is pressed, the movable inner sheet 32 will press the valve rod 16 again so as to achieve the operation of continuous shooting.

Figure 10:
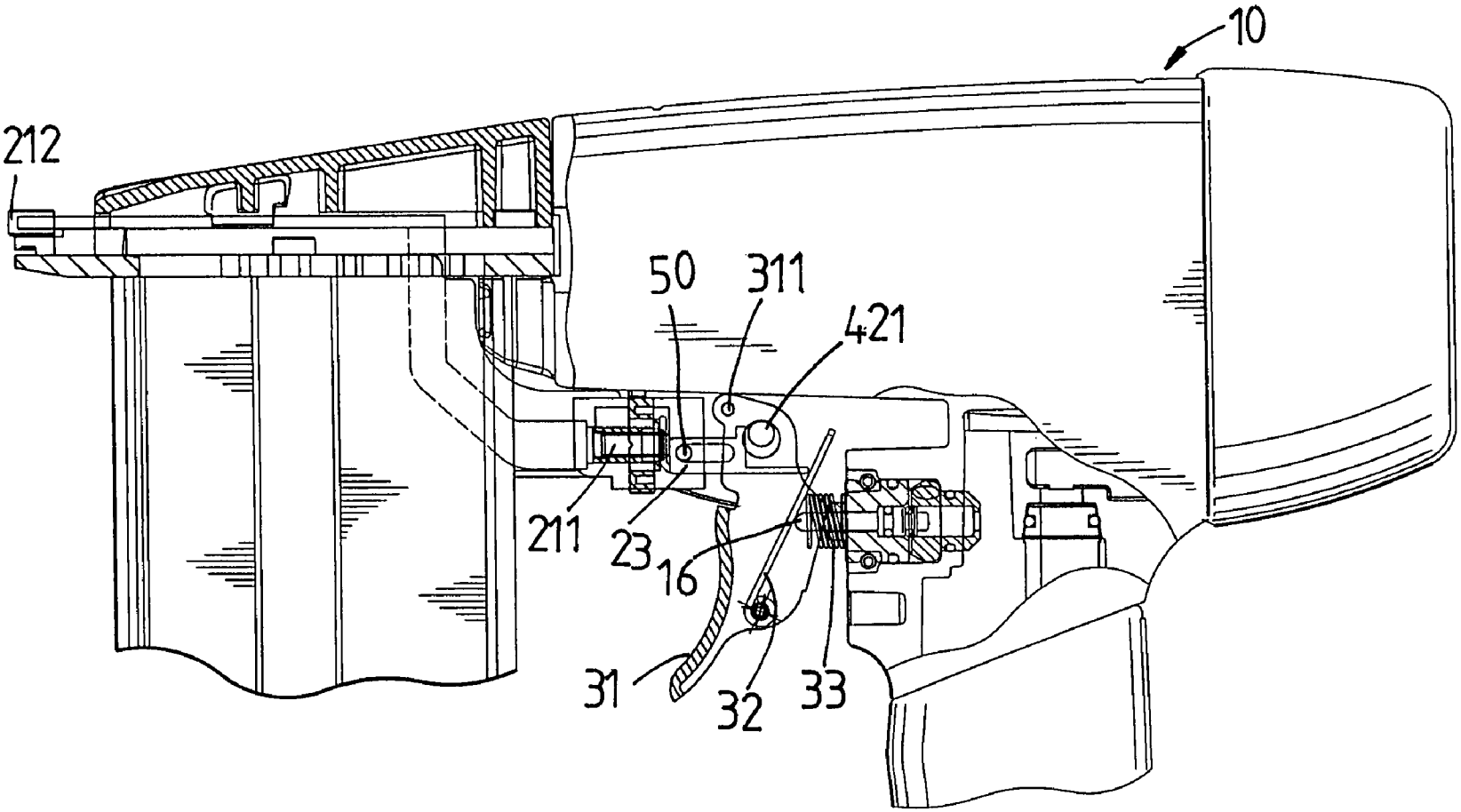
FIGS. 10 and 11 are schematic views showing another kind of single operation of the present invention.
Figure 11:
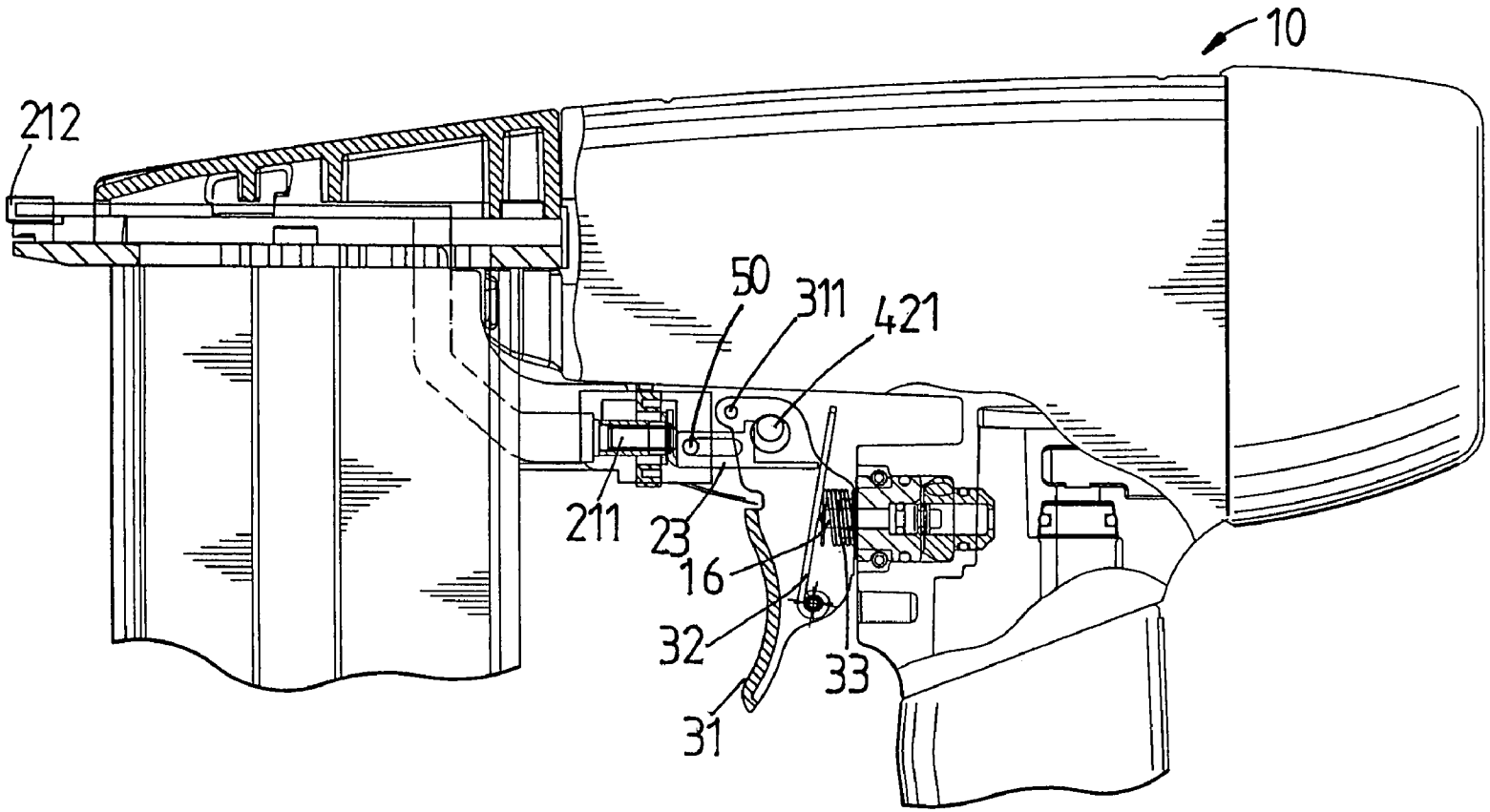

With reference to FIG. 10, it the trigger 31 is pressed firstly, the trigger 31 will rotate through an angle around the eccentric shaft 41 so that the resisting portion 311 of the trigger 31 will move, but not to the right upside of the touch block 23. if the press section 212 of the safety rod 21 is pressed again (referring to FIG. 11), the touch block 23 will move upwards. It is not hindered by the resisting portion 311, but to push the movable inner sheet 32 to press the valve rod 16 so as to complete the operation of single shooting. Further, the trigger 31 is released, the elastic force of the elastomer 33 will separate the movable inner sheet 32 from the valve rod 16. When the trigger 31 is pressed again, the movable inner sheet 32 will push the valve rod 16 again so as to complete the operation of single shooting.

Advantages of the present invention will be described herein.

The safety rod is retained as that in the prior art and thus no mistake occurs so as to achieve the object of safety operation. Other than the operations of single shooting and continuous shooting, a combining operation is designed so as to provide a further selection to the user. The structures of the safety device, triggering means, and switch are simple and can be assembled easily. Moreover, the cost is low.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A trigger device used in single shooting and double shooting of a nail driver comprising:

a machine body having a safety device; one end of the safety device being at a front end of the machine body;

a switch having an eccentric shaft and an adjusting body; the eccentric shaft being pivotally installed to the machine body; the adjusting body having an eccentric hole; the adjusting body being pivotally installed to the eccentric shaft; and a triggering means having a trigger, a movable inner sheet and an elastomer, the triggering means capable of being pushed by another end of the machine body; wherein one end of the trigger has a resisting portion; the resisting portion has a hollow portion; a touch block is movable in the hollow portion; one end of the trigger is pivotally installed to the eccentric shaft of the switch; and another end of the trigger is pivotally to the movable inner sheet; the movable inner sheet resists against the eccentric shaft; the elastomer is installed to a valve rod of machine body and resists against the movable inner sheet;

wherein when the safety rod and the trigger are pressed, by the interaction of the safety device, switch and the triggering means, the nail driver is operated to beat nail one time or several times continuously.

2. The trigger used in single shooting and double shooting of a nail driver as claimed in claim 1, wherein one end of the driving block is formed with an annular trench which buckles the touch block by a C ring.

3. The trigger used in single shooting and double shooting of a nail driver as claimed in claim 1, wherein the safety device includes a safety rod, a driving block and the touch block;

wherein the driving block is received in the receiving portion of the sleeve; the resisting portion at one end of the safety rod resists against the driving block; the driving block is movably connected to the touch block; and the touch block is installed and movable on the machine body.

* * * * *